United States Patent [19]

Kulesza et al.

[11] 4,299,386

[45] Nov. 10, 1981

[54] ELECTRONIC FENCING GAME

[75] Inventors: Ralph J. Kulesza; Alan A. Hicks, both of Chicago; Gunars Licitis, Jr., Lombard; Howard J. Morrison, Deerfield, all of Ill.

[73] Assignee: Marvin Glass & Associates, Chicago, Ill.

[21] Appl. No.: 60,883

[22] Filed: Jul. 26, 1979

[51] Int. Cl.[3] ..... A63H 13/06

[52] U.S. Cl. ..... 273/85 F; 46/148; 273/1 F

[58] Field of Search ..... 273/1 R, 1 E, 1 M, 1 F, 273/85 R, 85 E, 85 F; 46/142, 148; 272/57

[56] References Cited

U.S. PATENT DOCUMENTS

| | | | |
|---|---|---|---|
| 1,745,434 | 2/1930 | McIntosh | 46/142 |
| 2,916,287 | 12/1959 | Davey | 273/1 F |
| 3,771,786 | 11/1973 | Bouldin | 273/1 F X |
| 3,864,870 | 2/1975 | Breslow et al. | 46/142 |
| 3,920,242 | 11/1975 | Reith et al. | 273/1 F |
| 4,030,731 | 6/1977 | Delcayre | 273/1 F |

FOREIGN PATENT DOCUMENTS

| | | | |
|---|---|---|---|
| 415762 | 7/1925 | Fed. Rep. of Germany | 46/142 |
| 466416 | 10/1928 | Fed. Rep. of Germany | 46/142 |
| 1096812 | 1/1961 | Fed. Rep. of Germany | 46/142 |
| 24909 | 3/1963 | Fed. Rep. of Germany | 273/1 F |
| 725355 | 2/1932 | France | 46/142 |

*Primary Examiner*—Paul E. Shapiro

*Attorney, Agent, or Firm*—Mason, Kolehmainen, Rathburn & Wyss

[57] ABSTRACT

A structure including a base member having two fencing figures mounted thereon for movement relative to the base and each other so that the conductive sword carried by each figure may be engaged one with the other and the figures manipulated so that the conductive sword of one figure may touch the conductive target area of the other figure, and vice versa. When the conductive swords of the robot figures touch a unique audible signal is produced which is in the motif of the popular concept of outer space sounds and simulates the swishing or swooshing character of a sword blade moving through the air. When the swords are separated this audible signal dies out slowly so as to give an echo or ethereal effect thereto. if the conductive sword tip of one figure is maneuvered to engage the conductive target area of the other figure a unique sound signal is generated and a corresponding portion of the figure is illuminated by a flashing light. These signals are continued until the fencing figures are removed to remote locations at which point the signals are terminated. After a hit has been made by one figure, facilities are provided for preventing the development of sword touch sounds after the hit and prior to the separation of the figures to their remote locations. Also, after a hit has been made by one figure, facilities are provided for preventing the other figure from thereafter producing a hit upon his opponent.

26 Claims, 7 Drawing Figures

ELECTRONIC FENCING GAME

BACKGROUND OF THE INVENTION

This invention relates to an electronic fencing toy or game, and more particularly, to a toy or game of the type wherein two fencing figures are controlled by opposing players and moved to engage in a fencing duel.

Over the years there have been a number of toys or games wherein two figures are controlled by the respective players in a manner simulating a fight or boxing match. Typical of such prior art arrangements is Breslow U.S. Pat. No. 3,864,870 wherein two figures are mounted for movement relative to each other, each having an actuator which can be manipulated by the player to cause their figure to fight with the opposing figure. If a target area on the opposing figure is struck by the actuator of the other figure a latch is tripped so that the figure which has been struck moves from an upright to a prone position thereby signalling the end of the fight. In the boxing toy or game disclosed in Glass et al U.S. Pat. No. 3,235,259 two boxing figures may be manipulated by the opposing players and when one figure is struck in a particular manner the losing fighter's head pops up, and a noisemaker produces an appropriate sound. Other boxing or fighting toys or games are shown, for example, in Goldfarb et al U.S. Pat. No. 3,845,956, Fletcher U.S. Pat. No. 3,106,800, Crowell U.S. Pat. No. 1,799,735, Carlson U.S. Pat. No. 2,393,289, Gilchrist U.S. Pat. No. 1,447,976, McIntosh U.S. Pat. No. 1,745,434, Davis U.S. Pat. No. 2,269,095, Armstrong U.S. Pat. No. 2,716,840 and Austrian Pat. No. 96,176.

SUMMARY OF THE INVENTION

It is a principal object of the present invention to provide a new and improved fencing toy or game wherein two fencing figures are mounted for controlled movement by the players to simulate a fencing duel.

It is another object of the present invention to provide a new and improved toy or game wherein two movably mounted fencing figures are provided with electrically conductive swords and facilities are provided for developing a unique audible signal during periods when the swords are in electrical contact with each other.

It is a further object of the present invention to provide a new and improved fencing toy or game wherein the audible signal decays in amplitude after disengagement of the conductive swords at a relatively gradual rate to provide an echo or ethereal effect for the audible signal.

It is another object of the present invention to provide a new and improved fencing toy or game wherein the audible signal produced upon engagement of the conductive swords of the fencing figures is developed by frequency modulating two different tone signals with a low frequency pulse type signal, the modulated tone signals then being combined to provide a composite sword touch tone signal which is produced each time the swords touch.

It is another object of the present invention to provide a new and improved fencing toy or game wherein a conductive target area is provided on each of the fencing figures and facilities are provided responsive to the engagement of the conductive sword tip of either figure with the target area of the other figure for developing both an audible and visual signal indicating that a hit has been scored on the opponent.

It is a further object of the present invention to provide an arrangement wherein facilities are provided responsive to a hit on the target area of the opposing figure for disabling the development of further audible signals in response to sword engagement.

It is another object of the present invention to provide a new and improved fencing toy or game wherein facilities are provided responsive to a hit on the conductive target area of the opposing figure for preventing the struck figure from thereafter causing a hit upon his opponent.

It is another object of the present invention to provide a new and improved fencing toy or game wherein facilities are provided for resetting the visual and audible generating means in response to movement of the figures to spaced apart locations so that another duel may be initiated.

Briefly considered, the arrangement of the present invention achieves the foregoing objects in a structure including a base member having two fencing figures mounted thereon for movement relative to the base and each other so that the conductive sword carried by each figure may be engaged one with the other and the figures manipulated so that the conductive sword of one figure may touch the conductive target area of the other figure, and vice versa. Preferably, the figures are in the form of robots from outer space and when the conductive swords of the robot figures touch a unique audible signal is produced which is in the motif of the popular concept of outer space sounds and simulates the swishing and swooshing character of a sword blade moving through the air. When the swords are separated this audible signal dies out slowly so as to give an echo or ethereal effect thereto. If the conductive sword tip of one figure is maneuvered to engage the conductive target area of the other figure a unique sound signal is generated and a corresponding portion of the figure is illuminated by a flashing light. These audible and visual indicating signals are continued until the fencing figures are removed to remote locations at which point the audible and visual indicating signals are terminated. After a hit has been made by one figure, facilities are provided for preventing the development of sword touch sounds after the hit and prior to the separation of the figures to their remote locations. Also, after a hit has been made by one figure, facilities are provided for preventing the other figure from thereafter producing a hit upon his opponent.

Other objects and advantages will become apparent from the following description taken in connection with the accompanying drawings.

DESCRIPTION OF THE PREFERRED EMBODIMENT

Figure 1:
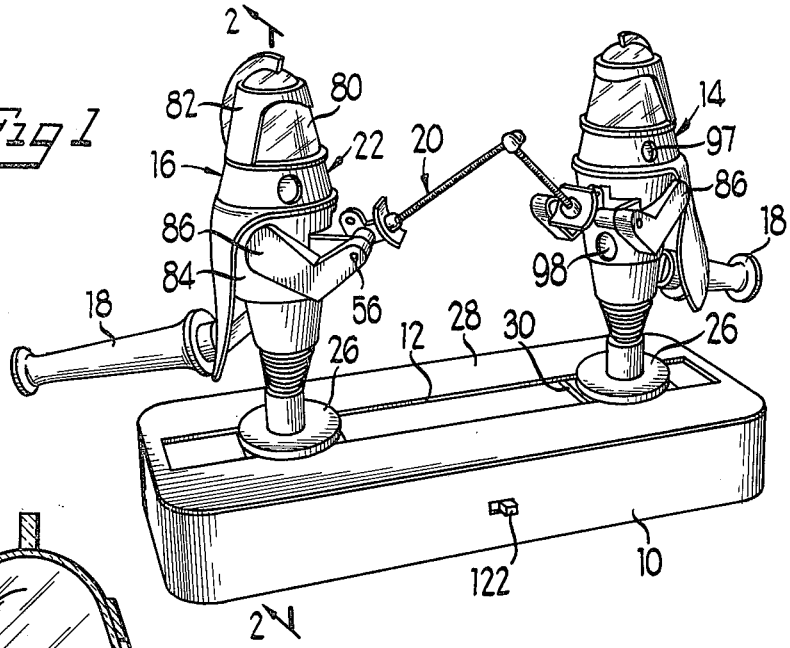
FIG. 1 is a perspective view of the fencing toy or game of the present invention.
Figure 4:
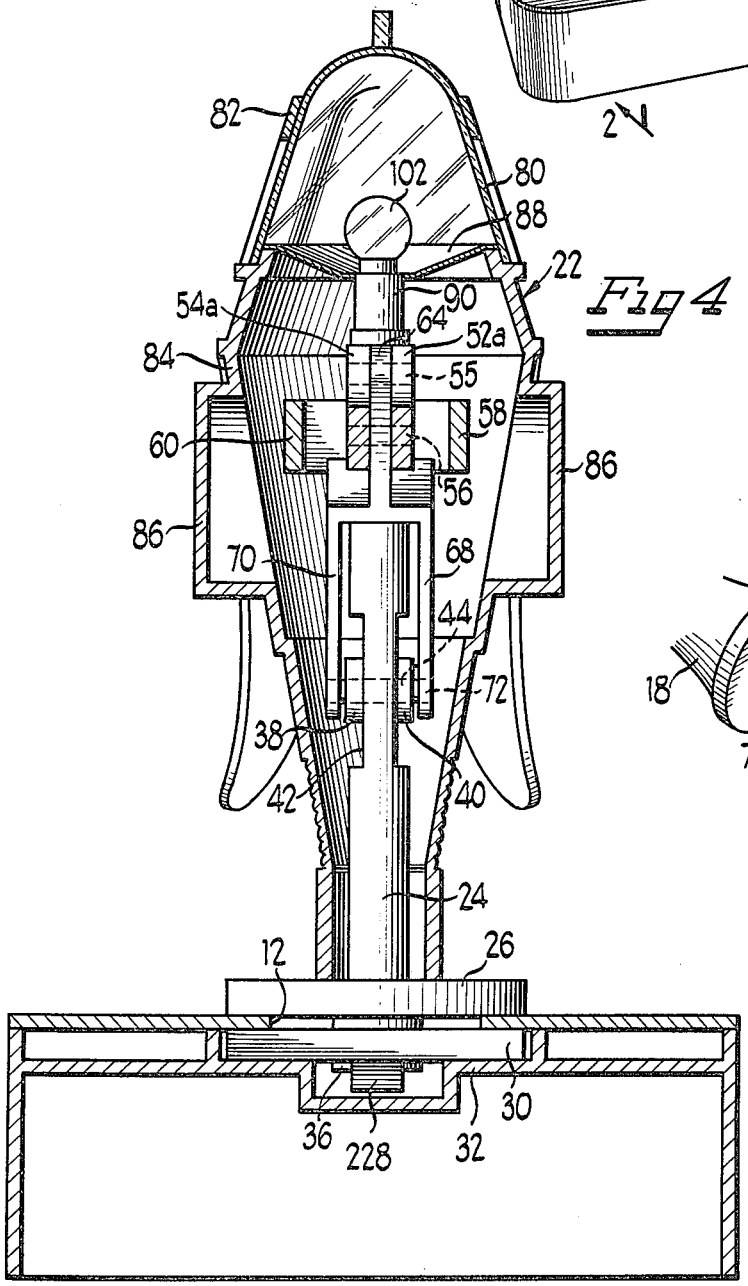
FIG. 4 is a sectional view taken along the line 4—4 of FIG. 3.
Figure 5:
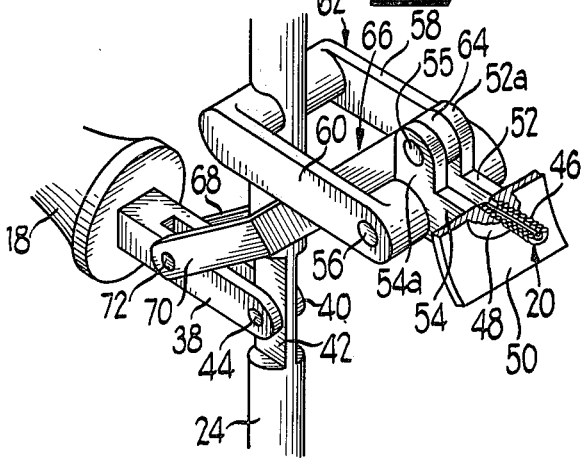
FIG. 5 is a fragmentary perspective view of the actuating mechanism employed in the toy of FIG. 1 to manipulate the conductive sword portion of the fencing figure.

Considering first the mechanical aspects of the fencing toy or game of the present invention, and referring particularly to FIGS. 1 to 5, inclusive, a base member 10 is provided having a longitudinally extending slot 12 in the upper surface thereof within which slot a pair of fencing figures 14 and 16 indicated generally at 14 and 16 are mounted for movement relative to each other and the base member 10. Each of the fencing figures 14, 16 is provided with a handle 18 by means of which the fencing figure may be moved along the length of the slot 12 and upon movement of the handle 18 to left or right the corresponding fencing figure is rotated about a vertical axis. In addition, up and down movement of the handle 18 is employed to produce corresponding up and down motion of a conductive sword portion 20 of the fencing figure. More particularly, each of the fencing figures 14, 16 includes an outer housing or body portion indicated generally at 22 and a centrally located post portion 24, the bottom end of the post 24 being connected to a circular disc 26 the edges of which ride on the upper surface of the top wall 28 of the base member 10. In the illustrated embodiment the body portions 22 of the figures 14, 16 are in the form of robots from outer space, although any suitable design for these figures may be employed insofar as the present invention is concerned.

A rectangular plate 30 is slidably mounted in the groove formed in the base member 10 by the top wall 28 thereof and a trough shaped lower wall 32 of the base member 10, the bottom end of the post 24 being rotatably mounted in the plate 30 by means of the screw 34 and washer 36 which retains the post 24 connected to the plate 30 while permitting rotation of the post 24 relative thereto.

The handle 18 of each fencing figure is provided with a pair of opposed end portions or fingers 38, 40 which are positioned on either side of a flat portion 42 of the center post 24. The handle 18 is pivotally mounted to the post 24 by means of the pin 44 which extends through the fingers 38, 40 and the post portion 42.

The conductive sword 20 of each fencing figure comprises an electrically conductive flexible coil of wire 46 one end of which is mounted in a centrally located hub portion 48 of an arcuately shaped plastic plate member 50, the portion 48 and plate 50 simulating the hilt or guard of a conventional sword. In order to rotate the sword 20 about a horizontal axis the plate 50 is provided with a pair of rearwardly extending arm portions 52, 54 which are pivotally mounted on a pin 56 which is supported between the opposed arms 58, 60 of a support assembly 62 secured to the central post 24. Preferably the assembly 62 may be formed with the post 24 in a one-piece molding operation.

In order to control rotation of the sword 20 about the pin 56 in accordance with up and down movement of the handle 18 about the pin 44, the arms 52, 54 are provided with offset extensions 52*a*, 54*a* between which is positioned the end portion 64 of an interconnecting link indicated generally at 66, the other end of the link 66 terminating in the parallel arms 68, 70 which are connected to the arms 38, 40 of the handle 18 by means of the pin 72. The arms 52*a*, 54*a* are positioned on either side of the upper end 64 of the link 66 and connected thereto by means of the pin 55.

With the manipulating arrangement described thus far, each of the fencing figures 14, 16 with its conductive sword 20 may be moved along the slot 12 by pushing or pulling on the handle 18, each figure may be rotated about the axis of the post 24 by rotation of the handle 18 about this vertical axis and the sword 20 of each figure may be pivoted about the horizontal axis of the pin 56 by corresponding pivotal movement of the handle 18 relative to the post 24. In this connection it will be noted that movement of the handle 18 produces movement of the sword 20 in the same direction due to the inverting connection of the link 66 between these members.

In the illustrated embodiment, each of the housing or body portions 22 of the fencing figures are arranged to simulate a robot type of fencing figure. Thus, each housing includes a transparent face mask portion 80 and a translucent helmet portion 82. The body 84 of each figure includes integral arm portions 86 in the ends of which the pin 56 is secured so that the body 22 rotates with the post 24 when the handle 18 is rotated. Also, the body 22 is centered at the upper end thereof by means of a disc-shaped member 88 which is provided with a central opening for receiving the upper end 90 of the post 24. The outer edge of the member 88 rests on the upper edge of the body portion 84 so that the fencing figure is centrally located with respect to the upper end of the post 24, the body portion 84 extending downwardly to the surface of the disc 26 so as to enclose the above-described mechanism for rotating the sword 20. One side of the body portion 84 is provided with an opening 92 to permit pivotal movement of the handle 18 relative to the post 24 and the other side of the body 84 is provided with the slot 94 to permit movement of the link 66 as the sword 20 is moved in response to pivotal movement of the handle 18.

Each of the fencing figures is provided with an opening 96 in the body portion 80 on the side facing the opposing figure and a conductive plate 98 is secured in place behind the opening 96 by any suitable means. If desired a second target area may be provided on each figure, as indicated generally at 97 in FIG. 2, this area also containing a conductive target plate which may be electrically connected to the plate 98. Each of the conductive swords 20 of the fencing figures is provided with a conductive tip portion 100 and the control circuit of the fencing game is arranged so that whenever the conductive tip portion 100 of the fencing figure makes electrical contact with the target 98 (or the target 97) an indicator lamp 102, which may comprise a number 47 pilot light, is illuminated to indicate that a hit on the opposing figure has been made. The indicator lamp 102 is mounted in an electrical socket provided in the upper end portion 90 of the post 24 of each figure, the member 88 acting as a reflector for the lamp 102. When the lamp 102 is illuminated, light from this lamp passes through the transparent dome portion 80 to indicate to the players that a hit has been made. Preferably the transparent portions 80 of each figure are of different colors, such as red and blue. In addition, when a hit is made on the target area 98 of the opposing figure an audible sound is produced, as will be described in more detail hereinafter.

Figure 2:
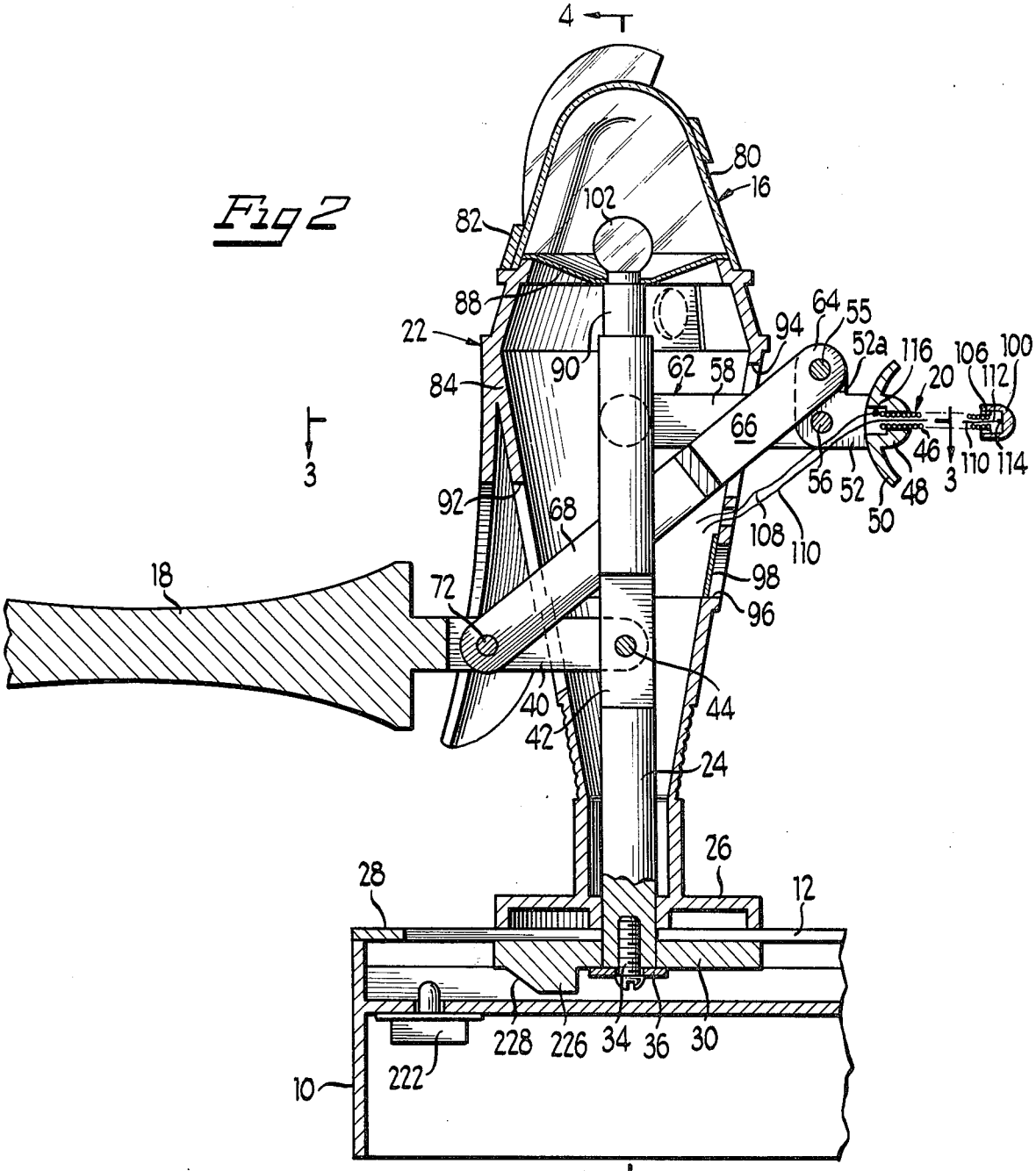
FIG. 2 is a sectional view taken along the line 2—2 of FIG. 1.
Figure 3:
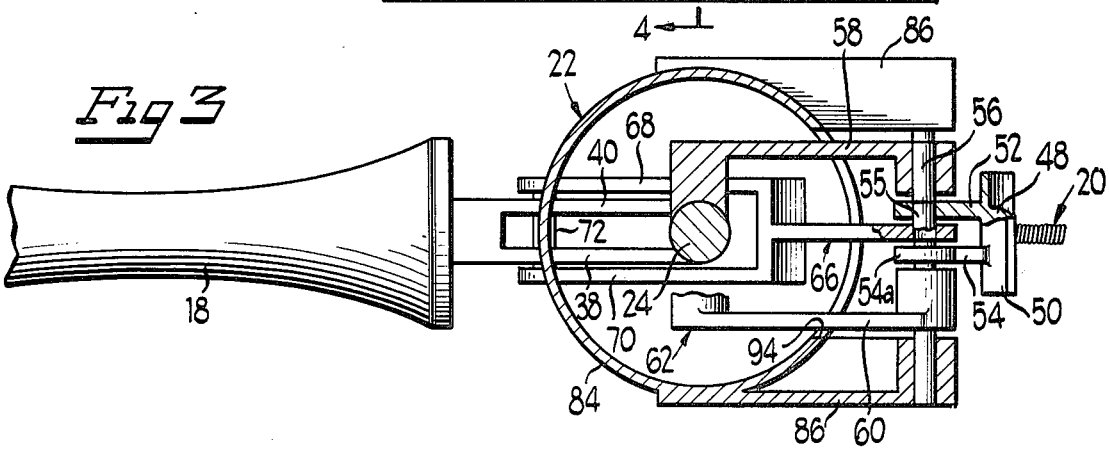
FIG. 3 is a sectional view taken along the line 3—3 of FIG. 2.
Figure 6:
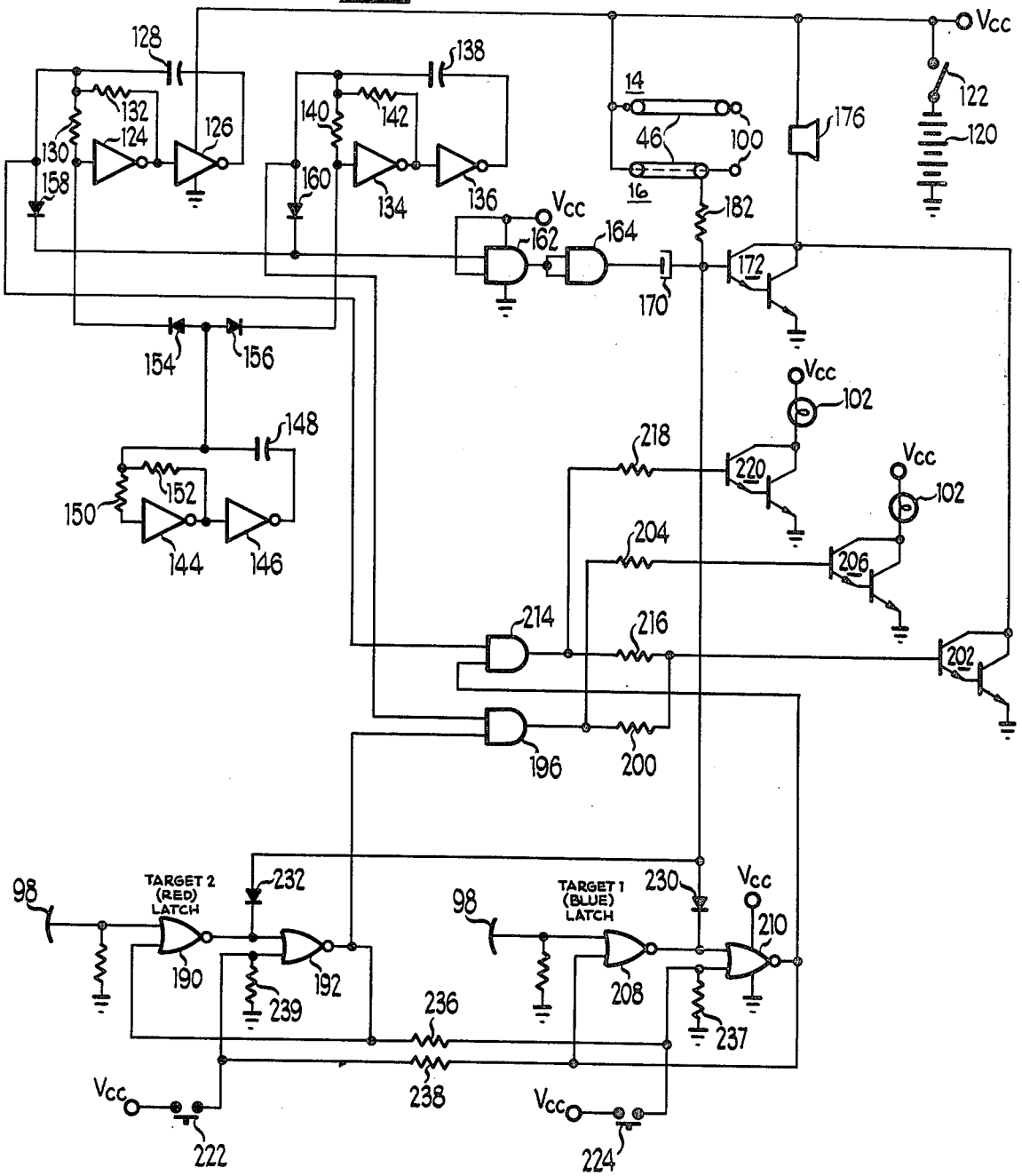
FIG. 6 is a circuit diagram of the electronic control circuit employed in the toy of FIG. 1 to provide the desired audible and visual signals during playing of the game.

Before considering the circuit arrangement of the present invention, which is shown in FIG. 6, it is pointed out that one of the fencing figures, such as the figure 16, has the conductive tip portion 100 of its sword 20 electrically insulated from the outer end of the electrically conductive coil of wire 46 which forms the flexible shaft portion of the sword 20. More particularly, as shown in FIG. 2, an insulating sleeve 106 is secured to the outer end of the flexible coil 46 and the conductive tip portion 100 is secured to the outer surface of the sleeve 106 by any suitable means. In the fencing figure 16 separate wires 108 and 110 are connected respectively to the end of the coil 46 and the conductive tip portion 100. The wire 110 is insulated and its conductive end portion 112 is connected to the conductive tip portion as indicated by the connection 114, the insulated wire 110 extending back through the center of the coil 46. The wire 108 is connected to the inner end of the coil 46 as indicated by the connection 116. In the other fencing figure 14, the insulating sleeve 106 is eliminated and the conductive tip portion 100 is electrically connected to the outer end of the coil 46. Accordingly, in the fencing figure 14, only the single wire 108 is required to make an electrical connection to the coil 46 and the tip 100.

Considering now the circuit arrangement of the present invention shown in FIG. 6, a low voltage supply potential indicated by the symbol $V_{cc}$ is provided by the batteries 120 and this supply potential is connected to the control circuit of the invention through the ON OFF switch 122. A first tone signal, which preferably has a frequency of 1.1 KHz is developed by a phase shift oscillator which includes the inverting amplifiers 124 and 126 which form a part of an integrated circuit chip which is preferably of the commercial type 4069, the pin connections for this chip being shown in FIG. 6. The output of the amplifier 126 is connected through the feedback capacitor 128 and the resistor 130 to the input of the amplifier 124. This capacitor is also connected to the resistor 132 to the input of the amplifier 126 so that a sufficient phase shift is provided to produce sustained oscillations at a frequency of 1.1 KHz at the junction of the capacitor 128 and the resistor 132. A similar tone generator, comprising the amplifiers 134 and 136 on the type 4069 chip, the capacitor 138, and the resistors 140 and 142 is provided to generate a tone signal having preferably a frequency of 750 Hz. A third pulse type oscillator is provided by the amplifiers 144 and 146 on the type 4069 chip, the capacitor 148, and the resistors 150 and 152, this third oscillator providing an output of seven pulses per second. The output of this third oscillator is employed to frequency modulate both of the tone signals developed by the first two oscillators. More particularly, the seven p.p.s. output of the third oscillator is supplied through a diode 154 to the input of the amplifier 124 and through the diode 156 to the input of the amplifier 134.

The frequency modulated outputs of the two tone generators are combined by means of the diodes 158 and 160 which are connected to the input of a non-inverting buffer section comprising the AND gates 162 and 164. The stages 162 and 164 preferably form a part of an intergrated circuit of the commercial type 74C08, the terminal connections for these AND gates being shown in the drawing. The gates 162, 164 provide some degree of limiting which, together with the frequency modulation components of the two frequency modulated tone signals which are combined and mixed in these gates, produces a unique composite sword touch tone signal of a swishing and swooshing nature which is in the nature of the popular concept of outer space sounds and to a certain extent simulates a sword blade moving through the air. The output of the buffer section 162, 164 is supplied through a relatively large capacitor 170 to the base input of a two-stage Darlington amplifier 172. The output collector of the Darlington amplifier 172 is connected through a loudspeaker 176 to the supply potential $V_{cc}$, the emitter electrode of the output stage of the Darlington amplifier 172 being connected to ground. In the absence of an enabling bias on the base input of the Darlington amplifier 172, this amplifier in nonconductive and hence does not transmit the composite sword touch tone signal to the loudspeaker 176. However, the coil spring 46 of the conductive sword 20 of one of the fencing figures, i.e., the figure 16, is connected through a resistor 182 to the base input of the Darlington amplifier 172. The supply potential $V_{cc}$ is connected to the conductive coil 46 of the sword of the other fencing figure 14, as shown in FIG. 6, it being recalled that the conductive tip portion 100 of the figure 14 is also conductively connected to the end of the conductive coil 46, as shown diagrammatically in FIG. 6. When either the coil portion 46 or the tip portion 100 of the fencing figure 14 makes electrical contact with the coil 46 of the opposite fencing figure 16, the supply potential $V_{cc}$ is supplied through the resistor 182 to the base input of the amplifier 172 so as to enable this amplifier to supply an amplified composite sword touch tone signal to the loudspeaker 176. The Darlington amplifier 172 is thus turned on rapidly to provide a sharp attack time for the composite sword touch tone signal.

Figure 7:
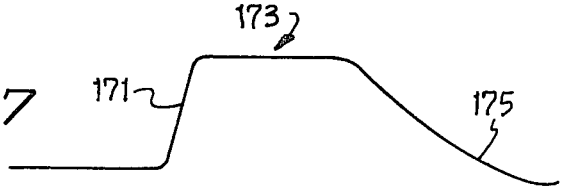
FIG. 7 illustrates the envelope of the sword touch tone signal developed in the game of FIG. 1.

In accordance with an important aspect of the invention, facilities are provided so that the sword touch tone signal decays slowly when the swords of the two figures 14, 16 are separated. During this decay, the seven-pulse-per-second frequency modulation components of the composite tone signal give an apparent echo or ethereal effect as the composite signal dies out. The envelope 173 of the composite sword touch tone signal is shown in FIG. 7. More particularly, when the swords touch and the supply potential is connected to the resistor 182, the large capacitor 170 is charged rapidly through the resistor 182 as shown by the leading edge 171 of the envelope 173 of FIG. 7. However, when the swords separate and a supply potential is no longer connected to the resistor 182, the capacitor 170 must discharge slowly through the high input impedance of the Darlington amplifier 172. Acccordingly, the amplitude of the composite tone signal decays slowly after the swords are separated, as shown by the decay portion 175 of the envelope 173 in FIG. 7, to provide the above-described echo effect in which the swooshing sounds of the frequency modulation components of the two tone signals are quite pronounced.

As discussed generally heretofore, when the conductive target area 98 of one of the figures is touched by the sword tip portion 100 of the opposing figure one of the tone signals developed by the above-described oscillators may be selectively supplied to the loudspeaker 176 to provide an audible indication that a hit has been made by one of the fencers. Furthermore, since the tone signals are distinguishable by their frequencies, an indicating means is provided whereby each player is immediately informed as to which player has made a hit while employing only the single loudspeaker 176 as the audible indicating means.

More particularly, when the target 98 of the figure 16 is electrically engaged by the sword tip portion 100 of the opposite figure 14, an enabling signal is supplied to one input of a NOR-gate 190, it being recalled that the sword tip portions 100 of both figures are connected to the supply potential $V_{cc}$, as shown in FIG. 6. The NOR-gate 190, together with a NOR-gate 192, forms an RS latch which is set when the supply potential $V_{cc}$ is connected to the target 98 as described above, these gates preferably forming a part of an integrated circuit chip of the commercial type 74C02. The NOR-gates 190 and 192 are cross connected in a conventional latch arrangement so that when the $V_{cc}$ potential is applied to the target 98 the output of the NOR-gate 192 goes from a low to a high potential and the output of the NOR-gate 190 goes from a high to a low potential. The output of NOR-gate 192 is supplied to one input of an AND gate 196, which may be on the same type 74C08 chip as the AND gates 162, 164, the other input of the AND gate 196 being connected to the frequency modulated tone signal output of the 750 cycle tone oscillator. The output of the AND gate 196 is supplied through a resistor 200 to the input of a Darlington amplifier 202 the output of which is connected to the loudspeaker 176. Accordingly, when the target 98 of the figure 16 is hit the latch 190, 192 is set, the gate 196 is enabled, and the 750 cycle tone signal is amplified in the amplifier 202 and supplied to the loudspeaker 176. The output of the AND gate 196 is also connected through a resistor 204 to the input of a Darlington amplifier 206 in the output of which is connected the pilot lamp 102. Accordingly, when the target area 98 of the figure 16 is hit, a visual signal is also produced by energization of its lamp 102. Since the tone signal supplied to the amplifier 206 is frequency modulated by the seven-pulse-per-second modulating signal, the visual indication provided by the lamp 102 is a flashing light which is visible through the transparent dome 80 of the figure 16.

In an entirely similar manner, the NOR-gates 208 and 210, which are on the same type 74C02 chip as the gates 190, 192, provide a latch which is set when the target 98 of the figure 14 is hit, the output of the NOR-gate 210 being supplied to one input of the AND gate 214 (on the type 74C08 chip) to the other input of which is supplied the 1.1 Kc frequency modulated tone signal. Accordingly, when the target 98 of the figure 14 is hit, the AND gate 214 is enabled and the corresponding tone signal is supplied through the resistor 216 to the amplifier 202 wherein it is amplified and supplied to the loudspeaker 176. The output of the AND gate 214 is also connected through the resistor 218 to a Darlington amplifier 220 which controls energization of the pilot light 102 of the figure 14, so that a flashing light signal is developed by the lamp 102 of the figure 14 when its target 98 is hit.

As soon as one of the latches 190, 192 or 208, 210 has been set in the manner described above, the corresponding tone signal will continue to be supplied to the loudspeaker 176 and will energize the corresponding one of the indicator lamps 102 until the latch is reset. In accordance with a further feature of the invention, these latch circuits are reset by moving the fencing figures apart to predetermined locations along the slot 12. More particularly, the reset switches 222 and 224 are provided at either end of the slot 12 and may be mounted in the bottom wall of the trough 32, as shown in FIG. 2. The plate 30 of each figure is provided with a depending portion 226 which has an inclined surface 228 which is adapted to engage the button of one of the switches 222 or 224 when the figure is moved to the end of the slot 12. When the reset switch 222 is closed it connects the supply potential $V_{cc}$ to the reset terminal of the latch 190, 192 so that this latch is returned to its initial condition. In a similar manner, the reset switch 224 resets the latch 208, 210 when it is closed. When the latch circuit is reset, the enabling potential is removed from the input of the AND gate 196 or the AND gate 214 so that the tone signal is no longer supplied to the loudspeaker 176 and the indicator lamp 102 is no longer energized.

In order to prevent any further sword play after a hit has been made on the target area of one of the figures, the sword touch tone signal is disabled when one of the latches 190, 192 or 208, 210 is set. More particularly, the output of the NOR-gate 208 is supplied through a diode 230 to the input of the amplifier 172 and the output of the NOR-gate 190 is connected through the diode 232 to the input of the amplifier 172. Normally, the outputs of the NOR-gate 190 and 208 are at a high potential and hence do not affect the operation of the amplifier 172. However, when either one of the latches 190, 192 or 208, 210 is set, a negative bias signal is supplied through the diode 230 or the diode 232 to the input of the amplifier 172 to prevent this amplifier from responding to the composite sword touch tone signal coupled to this amplifier through the capacitor 170. As soon as the fencing figures are moved apart and the latch is reset to its initial condition, the disabling biasing potential is removed from the input of the amplifier 172 so that this amplifier may thereafter respond to a composite sword touch tone signal when the swords of the two figures are next engaged, as described in detail heretofore.

In accordance with a further feature of the invention, there is provided means responsive to a hit by either player for locking out the target latch circuit of the other player to prevent the player who has just been hit (who is "dead") from rapidly scoring on his opponent, either on purpose or inadvertently, until after the player has caused his reset switch to be actuated. More particularly, a resistor 236 is connected from the output of the NOR-gate 192 to one of the inputs of the NOR-gate 210 in the opposing latch circuit, this input being connected to ground through the resistor 237. Similarly, a resistor 238 is connected from the output of the NOR-gate 210 to one of the inputs of the NOR-gate 192, this input being connected to ground through the resistor 239. When, for example, the latch 190, 192 is set, the high output of the gate 192 is supplied through the resistor 236 to the reset terminal of the latch 208, 210 and holds the latch 208, 210 in its initial condition even though the target 98 is hit and the $V_{cc}$ potential is supplied to the input of the gate 208. The latch 208, 210 acts in a similar manner through the resistor 238 on the latch 190, 192.

By way of illustration only, the following circuit valves have been found to be satisfactory in the circuit of FIG. 6;

Resistor 130—3.3 Megohms
Resistor 132—3,300 Ohms
Resistor 140—1.5 Megohms
Resistor 142—150,000 Ohms
Resistor 150—1.5 Megohms
Resistor 152—680,000 Ohms
Resistor 236, 238—3,300 Ohms
Resistor 237,239—10,000 Ohms
Capacitor 128—0.01 Mfd.
Capacitor 138—0.05 Mfd.
Capacitor 148—0.1 Mfd.

Capacitor 170—1.5 Mfd.
Diodes 154, 156, 158 and 160—type 1N4001
Diodes 230, 232—type 1N4148
Amplifers 172, 202, 206, 220—type 5305

While there has been illustrated and described a single embodiment of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent is:

1. In an electronic fencing game, the combination of, a pair of movably mounted fencing figures each having an electrically conductive movable sword, and means responsive soley to the electrical engagement of the conductive swords of said figures one with the other for developing an indicator signal.

2. The combination of claim 1, wherein said indicator signal is an audible signal the envelope of which has a relatively steep leading edge which occurs when said conductive swords touch and a gently sloping trailing edge which starts when said swords are disengaged one from the other.

3. The combination of claim 1, wherein said indicator signal developing means includes means for generating two tone signals of different frequencies, means for frequency modulating both of said tone signals with a third signal, and means for combining said frequency modulated tone signals to provide an audible sword touch tone signal.

4. The combination of claim 1, wherein said indicator signal developing means include a tone generator, means for frequency modulating said generator, electro-acoustic transducer means, and means responsive to engagement of said swords for supplying the modulated tone signal of said generator to said transducer means.

5. The combination of claim 4, which includes means responsive to disengagement of said swords for gradually reducing the amplitude of said modulated tone signal.

6. The combination of claim 1, wherein said indicator signal developing means includes a tone generator, electro-acoustic transducer means, amplifier means having an output connected to said transducer means, means for supplying a tone signal from said generator to the input of said amplifier means, means normally biasing said input so that said tone signal is not amplified in said amplifier means, and means responsive to engagement of said swords for enabling said input so that said tone signal is amplified in said amplifier means and is supplied to said transducer means.

7. The combination of claim 6, wherein one of said swords is connected to a source of enabling potential and the other sword is connected to said input.

8. The combination of claim 7, which includes a capacitor, means for charging said capacitor from said source of enabling potential in response to engagement of said swords, and means for discharging said capacitor through said amplifier input, said amplifier input having relatively high impedance so that the amplitude of said tone signal is gradually reduced when said swords are disengaged.

9. The combination of claim 8, wherein said amplifier means is a Darlington amplifier and said capacitor is connected in series to the input of said Darlington amplifier.

10. The combination of claim 1, wherein each of said swords comprises an electrically conductive flexible coil spring.

11. In an electronic fencing game the combination of, a pair of movably mounted fencing figures each having a movable sword provided with an electronically conductive tip portion, each of said figures having an electrically conductive target area, means responsive solely to the electrical engagement of the sword tip of one of said figures with the target area of the other figure for developing a first sound signal, and means responsive solely to the electrical engagement of the sword tip of the other of said figures with the target area of said first figure for developing a second sound signal which is distinguishable from said first sound signal, said game further including a single electroacoustic transducer, and means for supplying either an electrical signal corresponding to said first sound signal or an electrical signal corresponding to the said second sound signal to said transducer.

12. The combination of claim 11, which includes lockout means responsive to development of said first sound signal for thereafter preventing development of said second sound signal and responsive to development of said second sound signal for thereafter preventing development of said first sound signal.

13. In an electronic fencing game, the combination of, a pair of movably mounted fencing figures each having a movable sword provided with an electrically conductive tip portion, and a conductive blade portion, a conductive blade portion of one of said swords being electrically insulated from the conductive tip portion thereof, and means responsive to the engagement of said conductive blade portion of said one sword with said other sword for developing an audible signal, each of said figures having an electrically conductive target area, means responsive solely to the electrical engagement of the sword tip of one of said figures with the target area of the other figure for developing a first sound signal, and means responsive solely to the electrical engagement of the sword tip of the other of said figures with the target area of said one figure for developing a second sound signal which is distinguishable from a first sound signal area.

14. The combination of claim 13, which includes means responsive to development of either of said first or second sound signals for disabling said audible signal developing means.

15. The combination of claim 14, which includes a single electro-acoustic transducer, and means for selectively supplying electrical signals corresponding to said first and second sound signals and said audible signal to said transducer.

16. In an electronic fencing game a combination of, a pair of movably mounted fencing figures each having a movable sword provided with an electrically conductive tip portion, each of said figures having an electrically conductive target area, means responsive solely to the electrical engagement of the sword tip of one of said figures with the target area of the other firgure for developing a first sound signal, and means responsive solely to the electrical engagement of the sword tip of the other of said figures with the target area of said one figure for developing a second sound signal which is distinguishable from said first sound signal, said game further including a base member, means for mounting each of said figures on said base member for movement along a predetermined path relative thereto, and means responsive to movement of said figures to spaced apart locations along said path for terminating development of either said first sound signal or said second sound signal.

17. In an electronic fencing game, the combination of, a pair of movably mounted fencing figures each having a movable sword provided with a conductive portion, each of said figures having a conductive target area, indicator means for each of said figures, and means responsive solely to electrical contact between the conductive sword portion of one of said figures and the conductive target area of the other figure for energizing the indicator means thereof, said game further including latch means responsive to engagement of the conductive sword portion of one figure with the target area of the other figure for developing a continuous control signal, means for controlling said indicator means in accordance with said control signal, and means for resetting said latch means, thereby to terminate said control signal, said reset means including switch means positioned to be actuated by movement of said figures to spaced apart locations.

18. The combination of claim 17, which includes means responsive to energization of either one of said indicator means for preventing energization of the other indicator means.

19. The combination of either of claims 17 or 18, wherein said indicator means each develop an audible signal.

20. The combination of claim 19, wherein said audible signals developed by each of said indicator means are distinguishable from each other.

21. The combination of either of claims 17 or 18, wherein said indicator means each develop a visual signal.

22. The combination of claim 21, wherein said visual signals developed by each of said indicator means are distinguishable from each other.

23. The combination of claim 17, wherein said figures are movably mounted within a slot in a base member and said switch means comprises a pair of reset switches positioned to be individually engaged by said figures when said figures are moved to predetermined spaced apart locations along said slot.

24. A fencing game, comprising a base member having an elongated slot therein, a pair of fencing figures each slidably mounted in said slot and rotatable about a vertical axis and each having a single handle adapted to be grasped by a player for manually moving the figure along said slot and rotating the same about said vertical axis, a sword pivotally mounted on each of said figures for movement about a horizontal axis, and means on each of said figures interconnecting said handle and said sword for moving said sword about said horizontal axis in response to movement of said handle relative to said figure, each of said figures including a central vertically extending post, means for mounting said handle on said post for rotation about an axis perpendicular to the vertical axis of said post, and link means interconnecting said handle and said sword so that when said handle is lifted said sword is lowered by rotation about said horizontal axis, said game further including a housing enclosing said central post and said link means, and means for connecting said housing to said post for movement therewith.

25. The fencing game of claim 24, wherein each of said figures includes a central vertically extending post, means carried by said post for supporting said sword for rotation about said horizontal axis at a point offset from said post, means for pivotally mounting said handle on said post for rotation about an axis perpendicular to the vertical axis of said post, and means interconnecting said handle and said sword so that pivotal movement of said handle about said perpendicular axis causes rotation of said sword about said horizontal axis.

26. The fencing game of claim 24, which includes indicator means positioned within said housing, and means responsive to engagement of the swords of the two figures one with the other for energizing said indicator means.

* * * * *